United States Patent [19]

Straubel

[11] 4,165,723

[45] Aug. 28, 1979

[54] FUEL INJECTION PUMP FOR INTERNAL COMBUSTION ENGINES

[75] Inventor: Max Straubel, Stuttgart, Fed. Rep. of Germany

[73] Assignee: Robert Bosch GmbH, Stuttgart, Fed. Rep. of Germany

[21] Appl. No.: 776,036

[22] Filed: Mar. 9, 1977

[30] Foreign Application Priority Data

Mar. 9, 1976 [DE] Fed. Rep. of Germany ..... 2609724
Feb. 11, 1977 [DE] Fed. Rep. of Germany ..... 2705719

[51] Int. Cl.[2] ..... F02D 3/04; F02D 1/00

[52] U.S. Cl. ..... 123/139 AR; 417/494; 417/499; 123/139 AE; 123/139 AD; 123/139 AF

[58] Field of Search ..... 123/139 AR, 139 AD, 123/139 AF; 417/494, 499

[56] References Cited

U.S. PATENT DOCUMENTS

| | | | |
|---|---|---|---|
| 2,225,019 | 12/1940 | Retel | 123/139 AR |
| 2,254,441 | 9/1941 | Müller et al. | 123/139 AR |
| 2,696,807 | 12/1954 | Junge et al. | 123/139 AR |
| 2,810,375 | 10/1957 | Froehlich et al. | 123/139 AR |

FOREIGN PATENT DOCUMENTS

| | | | |
|---|---|---|---|
| 403598 | 12/1933 | United Kingdom | 123/139 AR |
| 442554 | 8/1935 | United Kingdom | 123/139 AR |

*Primary Examiner*—David H. Brown
*Assistant Examiner*—Thomas H. Webb
*Attorney, Agent, or Firm*—Edwin E. Greigg

[57] ABSTRACT

A fuel injection pump for internal combustion engines includes a reciprocating and rotating pump piston. Fuel delivery to the pressure line connected to an injection valve can be interrupted by the opening of a main control orifice in the wall of the cylinder which permits fuel to return to a low pressure volume of the pump. In order to provide for pressure relief of the pressure line when no injection takes place, there are provided a pressure control valve and a pressure relief conduit which bypasses this valve. The pressure relief conduit terminates in an auxiliary control orifice in the wall of the cylinder and is also obturated by the piston during its motion. The two control orifices are so located as to be opened in a predetermined sequence. The piston surface includes portions which block the auxiliary control orifice during engine starting.

13 Claims, 5 Drawing Figures

FUEL INJECTION PUMP FOR INTERNAL COMBUSTION ENGINES

BACKGROUND OF THE INVENTION

The invention relates to a fuel injection pump for an internal combustion engine, in particular a diesel engine. A fuel injection pump of the type to which this invention relates has a cylindrical bore, and traveling therein a piston, the lateral surfaces of which are so embodied as to cooperate with openings in the wall of the cylinder. The injection pump further includes a relief bore, access to which is controlled by appropriately configured surfaces of the pump piston and which creates communication between the pressure line leading to the injection valve and a source of reduced pressure, preferably the suction chamber of the pump. It has been found by experience that the pressure in the individual fuel injection lines leading to the injection valves must be reduced in the time period between fuel injection events. The purpose of the pressure reduction is to avoid dribbling at the nozzles and to adapt the nozzles to the hydraulic conditions of the system. Preferably, the pressure in the pressure lines is kept as low as possible in between injection events. It has further been shown in experiments that good results are obtained with injection systems in which the static pressure is maintained constant, i.e., independent of load and engine rpm. A pressure relief of this type is sometimes called an equal pressure relief and efforts have been made for many decades to obtain a usable solution to this problem. For example, it is known to provide equal pressure relief valves which contain a second valve member controlling the passage from the injection nozzle to the pump working chamber which reduces the pressure in the pressure line after the termination of injection to a value which is determined by the force of the closure spring of the supplementary valve. Valves of this type are quite complicated and expensive to make, especially in multi-cylinder pumps, where it is also difficult to adjust all the individual valves to the same value due to unavoidable variations in dimensions. Furthermore, the changing pressures in the pressure lines do not permit maintaining the same static pressure under all operational conditions of the engine. In known injection pumps of the type described, the equal pressure relief is created by a direct connection between the pressure line and the suction space leading to the fuel injection pump. A relief conduit is opened for this purpose by an oblique control edge of the pump piston and permits a pressure decrease in the pressure line to the pressure which obtains in between injection events. In order to diminish or damp the abrupt pressure pulses during such relief operations, the known injection pumps include throttles in the return line for the fuel. A very serious disadvantage of such known injection pumps is that the fuel displaced by the piston from the moment that fuel delivery is terminated until it has reached its top dead center position is displaced through the pressure valve and through the relief line to the suction chamber. This continuing flow has detrimental and uncontrollable effects on the pressure relief of the valve pressure lines and substantially disrupts the effect of the throttle in the return line.

OBJECT AND SUMMARY OF THE INVENTION

It is a principal object of the invention to provide a fuel injection pump of the above-described general type in which the above-mentioned disadvantage is prevented, i.e., in which the fuel quantity delivered by the pump after termination of injection does not disturb the pressure relief in the pressure line. It is a further object of the invention to provide a fuel injection pump which permits control of the closure motion of the pressure valve and of the pressure relief of the line leading to the injection valve in mutually independent manner so as to achieve an improved and smoother pressure relief.

These and other objects are attained according to the invention by providing a connecting channel leading from the main control groove of the pump piston to the main working chamber of the pump. The flow through the connecting channel is controlled by a control surface which is part of the external surface of the pump piston. At the same time, there is provided an auxiliary control bore which is controlled by the same or another control surface on the pump piston and which permits the pressure relief of the fuel line. In this manner, the termination of fuel supply and the closure of the pressure control valve can take place simultaneously with the pressure relief of the fuel line or after some minor delay.

Any pressure fluctuations taking place just before fuel delivery during the reduced pressure phase of the suction stroke can be reduced by providing advantageously that the connection between the pump working chamber to the auxiliary control bore is closed prior to the onset and during the effective delivery stroke until just before the termination of injection. It has also been found to be particularly suitable if the piston is so embodied that the auxiliary control bore is opened when the piston has traveled a few tenths of a millimeter beyond the opening of the main control bore.

A particularly simple construction can be obtained if the control bore serves at the same time as suction conduit and fuel return conduit.

In an advantageous embodiment of the invention, the relief line contains a throttle to damp out pressure fluctuations and a portion of the auxiliary control line is a throttled bore.

In a preferred embodiment of the invention, the pressure valve installed between the pump working chamber and the pressure lines leading to the valves is a pressure relief valve, preferably an equal volume pressure relief valve. In this manner, a suitable equal volume relief can take place in addition to the equal pressure relief so as to provide optimum adaptation of the fuel injection system to the requirements of rapid valve needle closure and the prevention of dribbling at the nozzle.

It has also been shown that, when fuel injection pumps of the general type to which this invention relates have been arrested, and if the fuel lines leading to the injection valves have been drained, and if some of the flow cross sections have unfavorable dimensions, the fuel pump will be unable to deliver fuel when restarted. In such a case, the lines must be opened and bled before it is possible to obtain fuel delivery. In order to prevent this disadvantage and to improve the known pump to be capable of immediate fuel delivery when restarted, it is a further object and embodiment of the invention to provide that the connection between the pressure relief line and the chamber of lower pressure is closed during the engine starting for the entire stroke of the piston. This disposition prevents the air which may be present in the pressure line or the relief bore to be pushed back and forth between the pump working chamber and the pressure line. After the engine has started, the pump piston is rotated in known manner by the associated controller from its starting position into an intermediate position associated with an engine condition lying between idling and full load. At that time, the equal pressure relief process is again effective.

It is also particularly suitable if the piston control surface which cooperates with the auxiliary control bore exhibits an extension penetrating the region of the main control groove in the piston.

The invention will be better understood as well as further objects and advantages thereof become more apparent from the ensuing detailed description of two exemplary embodiments taken in conjunction with the drawing.

DESCRIPTION OF THE PREFERRED EMBODIMENTS

Figure 1:
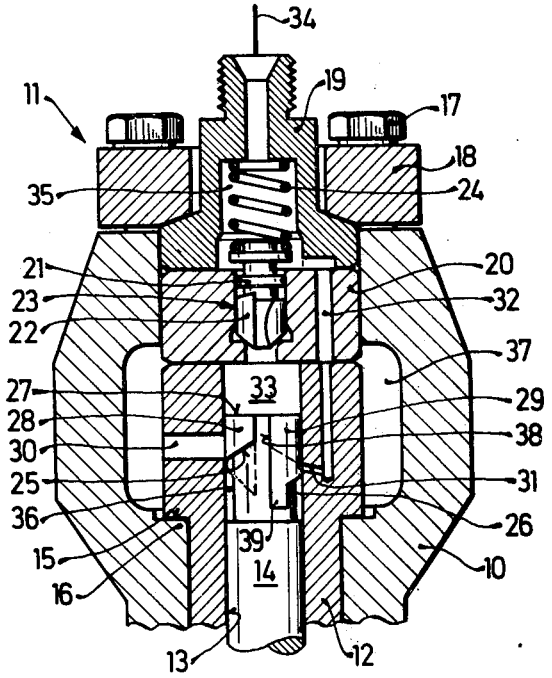
FIG. 1 is a longitudinal section through a first exemplary embodiment of an injection pump according to the invention.

Turning now to FIG. 1, and the first exemplary embodiment of the invention, there is shown a partial housing 10 of a fuel injection pump 11 including a pump cylinder 12 whose bore 13 guides a pump piston 14 which may move axially and rotationally. An annular shoulder 15 of the pump cylinder 12 is supported on a surface 16 within the housing 10 and is clamped against it by a clamping flange 18 with the use of screws 17. A tube connector 19 and a valve 20 are included between the flange 18 and the cylinder 12. The valve 20 comprises a movable valve member 22 with a suction ring 21 and constitutes an equal volume relief pressure valve 23. The valve member 22 is pressed onto its valve seat by a spring 24. The tube connector 19 is attached, in a manner not further shown, to a pressure line 34 which delivers fuel to a known pressure-controlled fuel injection valve, which is not shown.

The pump piston 14 is provided with two oppositely disposed oblique control edges 25 and 26 which define control surfaces 28 and 29, respectively. The control surface 28 cooperates with a main control aperture 30 disposed in the wall of the bore 13 and acting at the same time as a suction bore and fuel return bore. The second control surface 29 cooperates with an auxiliary control bore 31 within the wall of the bore 13 which is part of a pressure relief line 32 passing through the pump cylinder 12 and the valve 20. The pressure relief line 32 is so disposed as to circumvent the pressure control valve 23 and a pump working chamber 33. The latter is defined by the top 27 of the piston 14 and by a portion of the cylindrical bore 13 and communicates with the pressure line 34 through the valve 23. The preceding elements permit a direct communication of the pressure line 34 via a space 35 lying above the valve 23 and through the pressure relief line 32 with its auxiliary bore 31, and via an annular control groove 36 on the pump piston 14 with a suction volume 37 which surrounds the cylinder 12 in the vicinity of the main control aperture 30, provided that the control edges 25 and 26 have opened respective bores 31 and 30. In known manner, not further illustrated, the suction volume 37 communicates with a predelivery pump and thus experiences the pressure defined by a pressure limiting valve of the predelivery pump. Thus, when the connection between the suction chamber 37 to the pressure line 34 is opened via bores 30 and 31, the pressure within the pressure line 34 after the termination of the injection is the static pressure prevailing in the suction chamber 37, which is substantially lower than the normal fuel injection pressure.

Two longitudinal surface grooves in the piston 14 constitute connection channel 38 which connects the working chamber 33 with the control groove 36 so that, after the main control orifice 30 has been opened by the control edge 25, the working chamber 33 is effectively connected with the suction chamber 37, thereby terminating the injection event.

Figure 2:
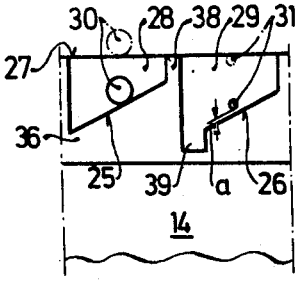
FIG. 2 is a planar development of the surface of the associated pump piston.

FIG. 2 is a planar development of the cylindrical surface of the pump piston 14. Shown in FIG. 2 are the main control orifice 30 and the auxiliary control orifice 31, shown in solid lines for the position of the pump piston 14 of FIG. 1. It will be seen that the control edge 25 just touches the edge of the main orifice 30 so that any further upward movement of the piston 14 would open the control orifice 30 and thus would terminate the injection event by causing communication through the control groove 36 and the connection channel 38 with the pump working chamber 33. In the position which the piston 14 occupies in both FIGS. 1 and 2, the second control edge 26 has not yet reached the auxiliary control bore 31 and is still separated from it by a distance labeled "a" equal to a few tenths of a millimeter. When the piston is in its bottom dead center position, the control bores 30 and 31 occupy positions relative to the piston 14 which are shown in dash-dotted lines in FIG. 2., i.e., the control bore 30 is substantially open, whereas the auxiliary control bore 31 is covered by the control surface 29. Thus, at the bottom dead center position of the piston, at the end of the suction stroke and during the entire effective delivery stroke it will remain closed. Accordingly, the second control edge 26 lies at a larger axial distance from the top of the piston 14 than does the first control edge 25. The fact that the auxiliary control bore 31 is closed at bottom dead center insures that any pressure surges occurring prior to the onset of fuel delivery in the suction chamber are kept away from the relief bore 32 and hence the fuel pressure line 34.

The control surface 29 which cooperates with the auxiliary control bore 31 has an extension 39 located adjacent to that part of the surface which controls the bore 31 in the engine domain between idling and full load. The extension 39 serves to block the connection between the relief bore 32 and the suction chamber 37 when the engine is being started, as will be explained in more detail with respect to FIG. 2*a*.

Figure 2A:
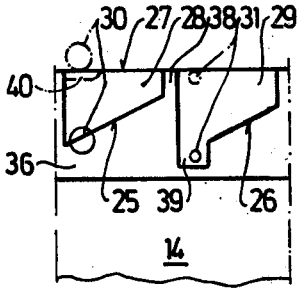
FIG. 2*a* is a development similar to that shown in FIG. 2 illustrating the pump piston in the starting position and at top dead center.

FIG. 2*a* shows the pump piston 14 and the associated control bores, the main control orifice 30 and the auxiliary control orifice 31 in the wall of the cylinder 12 in the position which they occupy at the top dead center position of the piston 14 when the engine is being started, as drawn in full lines. In the top dead center position, the extension 39 on the control surface 29 covers the auxiliary control bore 31 so that, during engine starting, this bore 31 remains closed for the entire pump working stroke. Thus, any air bubbles which may be present in the pressure line 34 are not merely pumped back and forth between that line and the work chamber 33, thereby preventing effective fuel delivery. As will be discussed in relation to the second exemplary embodiment, the extension 39 may also be formed by an interruption of the control groove 36 and a continuation into the adjacent surface of the pump piston. It is often the case that engine starting requires a different onset of fuel delivery than does normal engine operation. Such a different onset may be brought about by providing a starting groove 40, as illustrated in dash-dotted lines in FIG. *2a*.

A very favorable injection process and a dribble-free operation of the injection nozzle was obtained with a fuel injection system in which the pump piston had a diameter of 22 millimeters, the diameter of the main control orifice was 6 millimeters and the diameter of the auxiliary control bore was 0.9 millimeter. The dimension "a" was 0.4 millimeter.

However, the invention should be understood to include a slightly altered position of the auxiliary control bore 31, for examle one in which it is opened at the same time as, or shortly before, the main control bore 30. Again, the auxiliary control bore 31 could be opened for short periods of time in the bottom dead center position of the piston 14. Generally speaking, the position and size of the auxiliary control bore is a means for adapting the pressure relief of the lines to the hydraulic requirements of the injection system.

Figure 3:
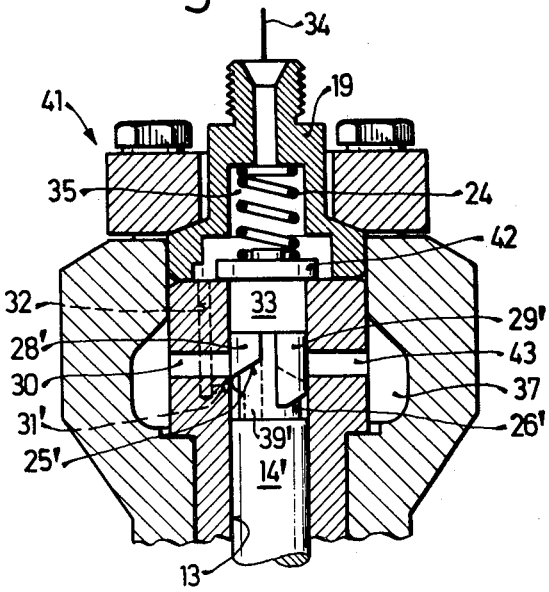
FIG. 3 is a longitudinal section similar to FIG. 1 through a second exemplary embodiment of the invention.
Figure 4:
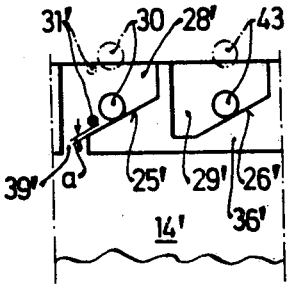
FIG. 4 is a planar development of the exemplary embodiment of FIG. 3.

The second exemplary embodiment of the invention, illustrated in FIGS. 3 and 4, shows a fuel injection pump 41 in which parts identical to the embodiment of FIG. 1 carry the same reference numeral, whereas those which are substantially modified are provided with primed numbers. The injection pump 41 is built in a substantially simpler manner than that illustrated in FIG. 1. For example, the pump working chamber 33 is closed by a simple pressure valve 42 embodied by a plate loaded by a spring 24. This valve could also be a ball valve. In known manner, the pump piston 14' has two channels and two substantially identical control surfaces 28' and 29', provided with edges 25' and 26', respectively. An important difference with respect to the first exemplary embodiment is that the auxiliary control bore 31' is located in the vicinity of the main control bore 30. As may be seen in FIG. 4, the auxiliary control bore 31' is located so as to be displaced toward the control edge 25' in the direction of the slope of that edge in such a way that, after a partial stroke "a," it is opened after the opening of the main control orifice 30. The pump piston 14', shown in FIGS. 3 and 4, could also have a single control surface 28', but a single channel embodiment of the pump piston is not desirable for two reasons; the first reason is that it would not provide hydraulic equalization and the second reason is to be found in the manner of manufacture. The availability of a second control orifice 43 opposite to the orifice 30 not only improves the process of filling the working chamber 33 and obtaining a rapid termination of injection, but also permits drilling the auxiliary bore 31' through the second control orifice 43. The relief line 32, drilled in the axial direction of the pump cylinder 12' and connected with the auxiliary bore 31, terminates directly into the pressure chamber 35 above the pressure valve 42.

An extension 39' on the control surface 28' is so embodied, by contrast to the extension 39 of the first example, as to interrupt the control groove 36' and to continue into the adjacent surface of the pump piston 14'. The function of this extension 39' is the same as previously described with respect to FIG. *2a*. The equal pressure relief, according to the invention, proceeds as follows:

In the first exemplary embodiment of FIG. 1, when the pump piston 14 moves upwardly from the position shown in the figure, the control edge 25 first opens the orifice 30 and, after a small further partial stroke "a," the second control edge 26 opens the auxiliary control bore 31. The pressure relief of the pump working chamber 33 via the connection channel 28, the control groove 36 and the orifice 30 to the suction chamber 37 terminates the fuel injection process and the pressure relief valve 23 closes after traversing a return stroke determined by the position of the suction ring 21, thereby interrupting the connection between the pump working chamber 33 and the pressure line 34. At approximately the same time, and preferably shortly after the termination of injection, the pressure line 34 is connected via the relief line 32, the auxiliary bore 31, the control groove 36 and the control orifice 30 to the same suction chamber 37, thereby lowering the static pressure in that line to that prevailing in the suction chamber. The size of the throttling auxiliary bore causes a damping effect during the pressure relief and controls the development of the pressure changes. The pressure relief takes place practically independently of any pressure changes caused by the valve 23 so that the two pressure relief mechanisms may be mutually adapted to permit optimum performance of the fuel injection system.

In the second exemplary embodiment, illustrated in FIGS. 3 and 4, the termination of fuel injection and the pressure relief are controlled by the same control edge 25'. Inasmuch as the pressure valve 42 does not cause any pressure relief of the line 34, the pressure relief takes place exclusively via the line 32 and the auxiliary bore 31'. The size and the final position of the auxiliary control bore 31' must be determined by appropriate experimentation.

In both exemplary embodiments, the control surfaces 29 or 28' which cooperate with the control orifice 31 have an extension 39 or 39', which in the engine starting position of the piston 14, 14', blocks communication between the relief bore 32 and the suction chamber 37, as already explained with respect to FIG. *2a*.

The foregoing relates to preferred embodiments of the invention, it being understood that other embodiments and variants thereof are possible within the spirit and scope of the invention.

What is claimed is:

1. In a fuel injection pump for internal combustion engines which includes a housing, a cylindrical bore within said housing, a piston disposed to reciprocate and rotate within said cylindrical bore, a pressure line connected to the working chamber of said pump, said chamber being defined by the top of said piston and by said cylindrical bore, said pressure line being closable by a pressure valve, said housing further including a pressure relief conduit leading from said pressure line to said cylindrical bore via an auxiliary control orifice, said pressure relief conduit being disposed so as to bypass said pressure valve and said pump working chamber and to open into said cylindrical bore by way of said auxiliary control bore, said piston having a plurality of control surfaces with oblique control edges which cooperate with a main control orifice in said cylindrical bore to thereby establish communication between said cylindrical bore and a space surrounding the same containing fuel at lower pressure than fuel injection pressure, the improvement comprising:

a channel in said piston leading from the end face thereof to the side surface thereof, said channel being connectable to said main control orifice by at least one of said control surfaces during the motion of said piston and said auxiliary control orifice being so disposed in said cylindrical bore as to be opened at approximately the same time as said main control orifice by one of said control surfaces.

2. A fuel injection pump as defined by claim 1, wherein said control surfaces are so disposed that the connection between said working chamber and said pressure relief conduit is closed prior to and during the effective fuel delivery stroke of said piston up to least just prior to the termination of fuel delivery and preferably also in the bottom dead center position of said piston.

3. A fuel injection pump as defined by claim 1, wherein said auxiliary control orifice is located substantially opposite said main control orifice in said cylindrical bore and at an axial distance from the top of the piston such that said auxiliary control orifice is opened by one of control surfaces approximately at the same time as said main control orifice is opened.

4. A fuel injection pump as defined by claim 1, wherein said auxiliary control orifice is disposed in said cylindrical bore in the vicinity of said main control orifice and so displaced therefrom in the general direction of said control edges as to be opened substantially simultaneously with said main control orifice by a lower one of said control edges.

5. A fuel injection pump as defined by claim 1, wherein said auxiliary control orifice is so located as to be opened after the opening of said main control orifice and after said piston has executed an upward stroke of a few tenths of a millimeter.

6. A fuel injection pump as defined by claim 1, wherein said main control orifice serves as influx and reflux conduit.

7. A fuel injection pump as defined by claim 1, wherein said pressure relief conduit contains a throttle.

8. A fuel injection pump as defined by claim 7, wherein said throttle is formed by a portion of said pressure relief line.

9. A fuel injection pump as defined by claim 1, wherein said pressure valve for closing off said pressure line from said pump working chamber is a pressure relief valve, preferably an equal volume pressure relief valve.

10. A fuel injection pump as defined by claim 1, wherein said auxiliary control orifice is located in said cylindrical bore in the vicinity of said main control orifice and displaced in the general direction of one of said oblique control edges so as to be opened substantially simultaneously with said main control orifice by a lower one of said control edges and further comprising a second main control orifice diametrically opposite the first main control orifice in said cylindrical bore.

11. A fuel injection pump as defined by claim 1, wherein a control surface on said pump piston is so disposed as to block communication between said pressure relief conduit and said volume surrounding said cylindrical bore during the entire stroke of said piston when said piston is in a position corresponding to engine starting.

12. A fuel injection pump as defined by claim 11, wherein said control surface blocking said auxiliary bore during engine starting has an extension which is adjacent to that portion of the control surface operative when the engine operates between idling and full load.

13. A fuel injection pump as defined by claim 12, wherein said extension of said control surface is so formed that it closes off said auxiliary control orifice during the entire stroke of said pump piston when said pump piston is positioned for engine starting.

* * * * *